US007080840B1

(12) United States Patent
Chen

(10) Patent No.: US 7,080,840 B1
(45) Date of Patent: Jul. 25, 2006

(54) GRABBER MACHINE WITH ENHANCED DESIGN

(76) Inventor: Yu-Hsiang Chen, No. 79-2, Jhongyi St., Minsyong Township, Chiayi County (TW)

( * ) Notice: Subject to any disclaimer, the term of this patent is extended or adjusted under 35 U.S.C. 154(b) by 3 days.

(21) Appl. No.: 11/119,641

(22) Filed: Apr. 30, 2005

(51) Int. Cl.
*A63B 7/36* (2006.01)

(52) U.S. Cl. ..... 273/447

(58) Field of Classification Search ..... 273/440, 273/447, 448
See application file for complete search history.

(56) References Cited

U.S. PATENT DOCUMENTS 4,685,673 A * 8/1987 Verstraeten ..... 273/448
4,718,667 A * 1/1988 Shoemaker, Jr. ..... 273/448
4,778,176 A * 10/1988 Shoemaker, Jr. ..... 273/448
5,415,417 A * 5/1995 Reis, Jr. ..... 273/447
D429,768 S * 8/2000 Smart ..... D21/325
6,283,475 B1 * 9/2001 Stubben ..... 273/448
6,428,008 B1 * 8/2002 Singer ..... 273/447
6,770,001 B1 * 8/2004 Shoemaker, Jr. ..... 473/447
6,899,337 B1 * 5/2005 Fisher et al. ..... 273/447

* cited by examiner

*Primary Examiner*—Raleigh W. Chiu

(57) ABSTRACT

A grabber machine with enhanced design is disclosed. The grabber machine includes a display cabinet, a base stand and two sets of mechanical arms, each containing a longitudinal jenny and a transversal jenny wire connected with a gripping tong. Each mechanical arm is electrically connected to an independent rocker and select button installed on an operational panel, which allows the player to position the gripping tong over an article and then grab the article sitting among others in the display cabinet. The unique design of this grabber machine is that it allows two or three players to operate on the machine concurrently and independently using different sets of mechanical arms and rockers. This grabber machine is able to recreate the player's passion in the recreational game.

2 Claims, 6 Drawing Sheets

GRABBER MACHINE WITH ENHANCED DESIGN

BACKGROUND OF THE INVENTION

1. Field of the Invention

The present invention relates to a grabber machine, and particularly to a recreational grabber machine that enables two or three players to operate concurrently using separate sets of mechanical arms and rockers.

2. The Related Art

Conventionally, a grabber machine is stocked with many different toys, such as teddy bears, Mickey mouse, chimpanzees or orangutans, displayed inside a transparent cabinet, and the player then maneuvers a rocker to align the mechanical arm over a selected article, which is a toy, and then presses on the select button to lower the gripping tong and grab the article from among others sitting in the transparent cabinet. Once the article is picked up successfully, it is dragged to one corner of the transparent cabinet, while one finger is continuously held on the select button all this time, until the selected article is directly over the drop-out opening. Then the select button is released to allow the article to fall through the aperture to the bottom of the machine, where the player can reach in through a pick-up bay to retrieve the article as the prize for winning a game.

Since the conventional grabber machine, with one set of rocker and mechanical arm, only allows one person to play alone, so it has become a boredom playing the game and lacks the challenges from the peers. However, if the grabber machine allows two or three players to play concurrently, the game could be far more exciting. The redesigning of the grabber machine requires more sophisticated control logic and high precision positioning, so that additional functions can be introduced to recreate the player's passion in the game once again.

SUMMARY OF THE INVENTION

The primary objective of the present invention is to provide a grabber machine with the addition of one or two sets of mechanical arms and rockers to make the grabber machine available to two or three players at the same time.

To this end, the architecture of the grabber machine includes a display cabinet, a base stand and two or three sets of mechanical arms, where each set of mechanical arms contains a longitudinal jenny and a transversal jenny, which is wire connected with a gripping tong, and each mechanical arm is electrically connected to an independent rocker and select button installed on the operational panel in front of the display cabinet, so that two or three players are able to play concurrently and independently.

In accordance with the present invention, once the mechanical arm is positioned over a selected article, the select button is pressed to lower the gripping tong and grab the article, and the article is then dragged to one corner with a drop-out opening, and the article is dropped to the bottom of the grabber machine for retrieval from the pick-up bay.

In accordance with the present invention, the enhanced grabber machine allows two or three players to play on the machine concurrently each using separate sets of mechanical arms, rockers, and select buttons. Each player can maneuver the tong up and down, left and right, and even diagonally to cover all territories within the boundary of the cabinet, which means the present control system allows players to cross over each other in order to position their tongs over the selected articles concurrently.

The advantage of using the enhanced grabber machine over the conventional model is that this grabber machine can be a highly competitive game for the participating players, thus producing far more excitement than one player alone.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
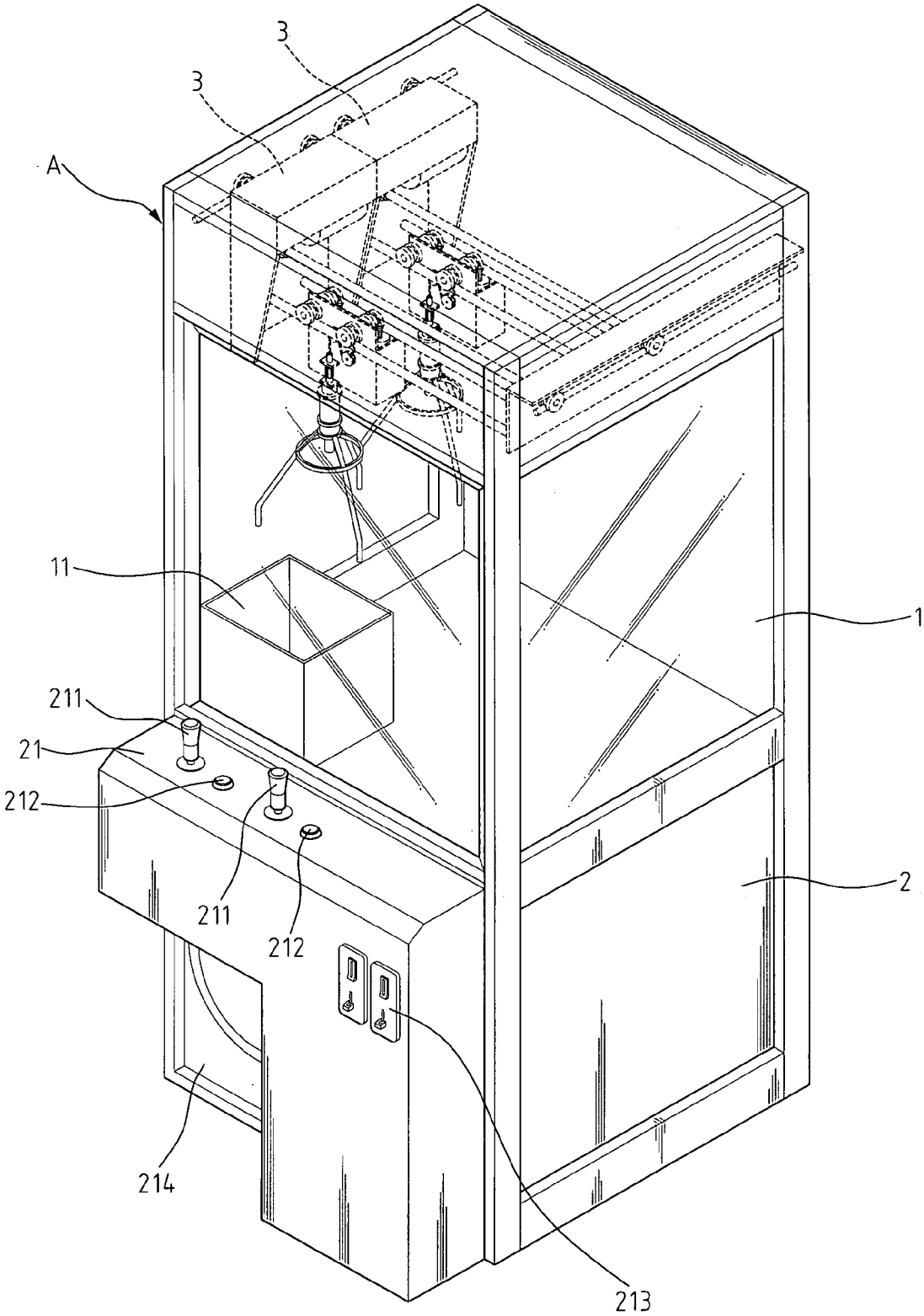
FIG. 1 is a perspective view of the present invention.
Figure 3:
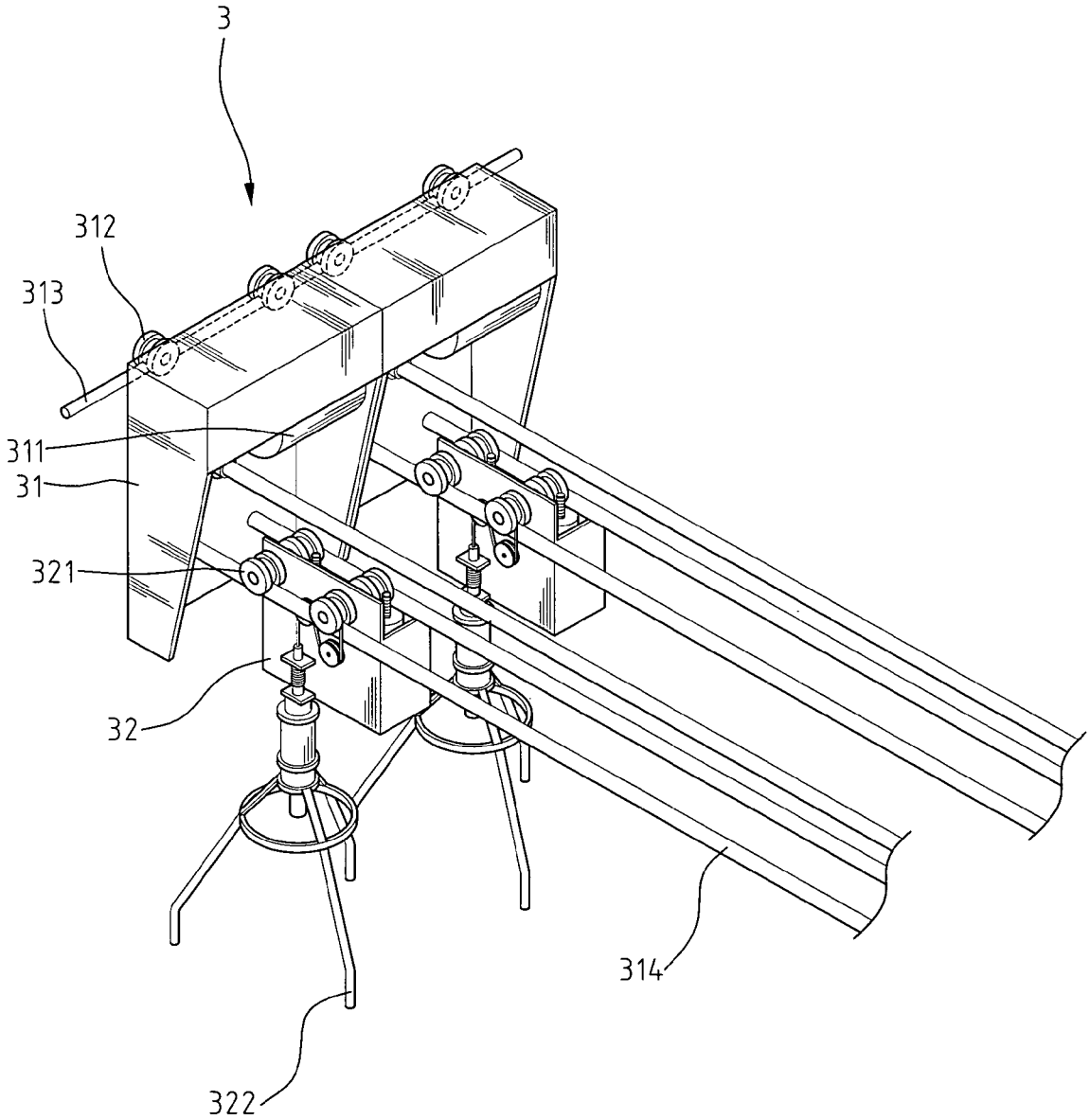
FIG. 3 is an enlarged view of the structure of the mechanical arm of the grabber machine.

Referring to FIGS. 1 and 3, the proposed grabber machine (A) is composed of a display cabinet 1, a base and control cabinet 2 housed underneath the display cabinet 1, and two or three sets of mechanical arms 3, where an operational panel 21 is disposed in front of the display cabinet 1 and on top of the base and control cabinet 2, over which two or three sets of rockers 211 and select buttons 212 are installed, each controlling one mechanical arm 3 set up below the ceiling of the display cabinet 1. Also, the front panel of the base and control cabinet 2 has two or three coin slots 213 and a pick-up bay 214.

The display cabinet 1 has a square-shaped drop-out opening 11 on one of the four corners, through which the selected article can be dropped to the bottom of the grabber machine to be retrieved from a pick-up bay 214. Each set of mechanical arms 3 contains a longitudinal jenny 31 and a transversal jenny 32, each of which has a motor (not shown in the drawing) installed underneath the frame for driving the roller.

Each longitudinal jenny 31 is mounted below the ceiling of the display contain 1 using a pair of rollers 312 on the back side of the jenny 31 to fit onto a common longitudinal rail 313. Each longitudinal jenny 31 has a pair of transversal rails 314 and a connecting rod extending from the broad side to a movable plate on the opposite site side of the display cabinet 1, supported by a pair of rollers 312 and a longitudinal rail 313. The longitudinal jennies 31 are installed on the common longitudinal rail 313.

Each transversal jenny 32 is mounted using two rows of rollers 321 fitted onto transversal rails 314, where one end of the transversal rail 314 holding the transversal jenny 32 is connected to the broad side of a longitudinal jenny 31, and the other end is connected to the broad side of a movable plate on the opposite side of the display cabinet 1. The transversal jennies 32 are installed on separate transversal rail 314 parallel to each other. Each transversal jenny 32 is wire connected with a gripping tong 322 on the back side.

Each jenny 31, 32, longitudinal and transversal, is equipped with a motor and a transmission mechanism (not shown in the diagram), and embedded with a circuit board used to drive the rollers 312, 321. The embedded circuit boards in the jennies 31, 32 are electrically connected to the base and control cabinet 2 for receiving input signals issued by the player through the action of the rockers 211 and select buttons 212.

Figure 4:
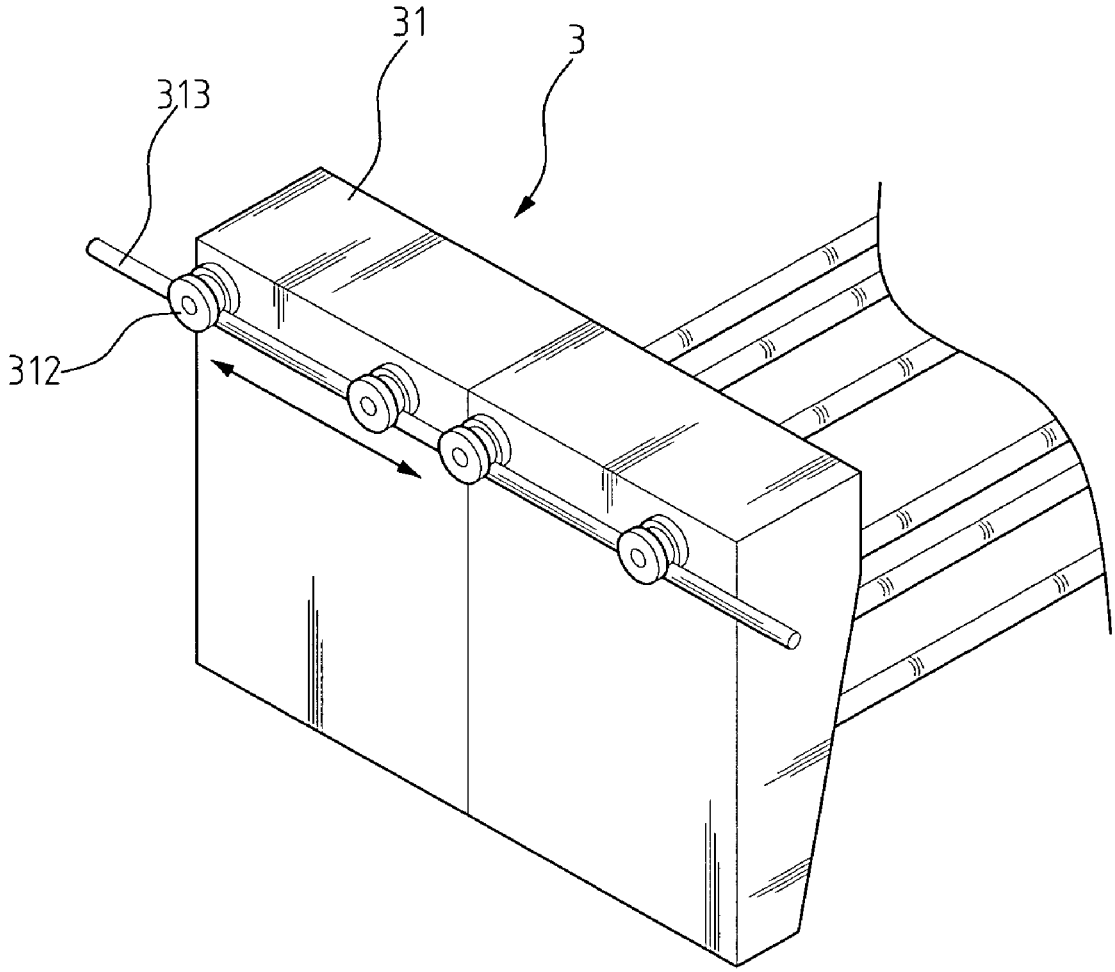
FIG. 4 shows the directional movement of longitudinal jenny in the first part of a mechanical arm.
Figure 5:
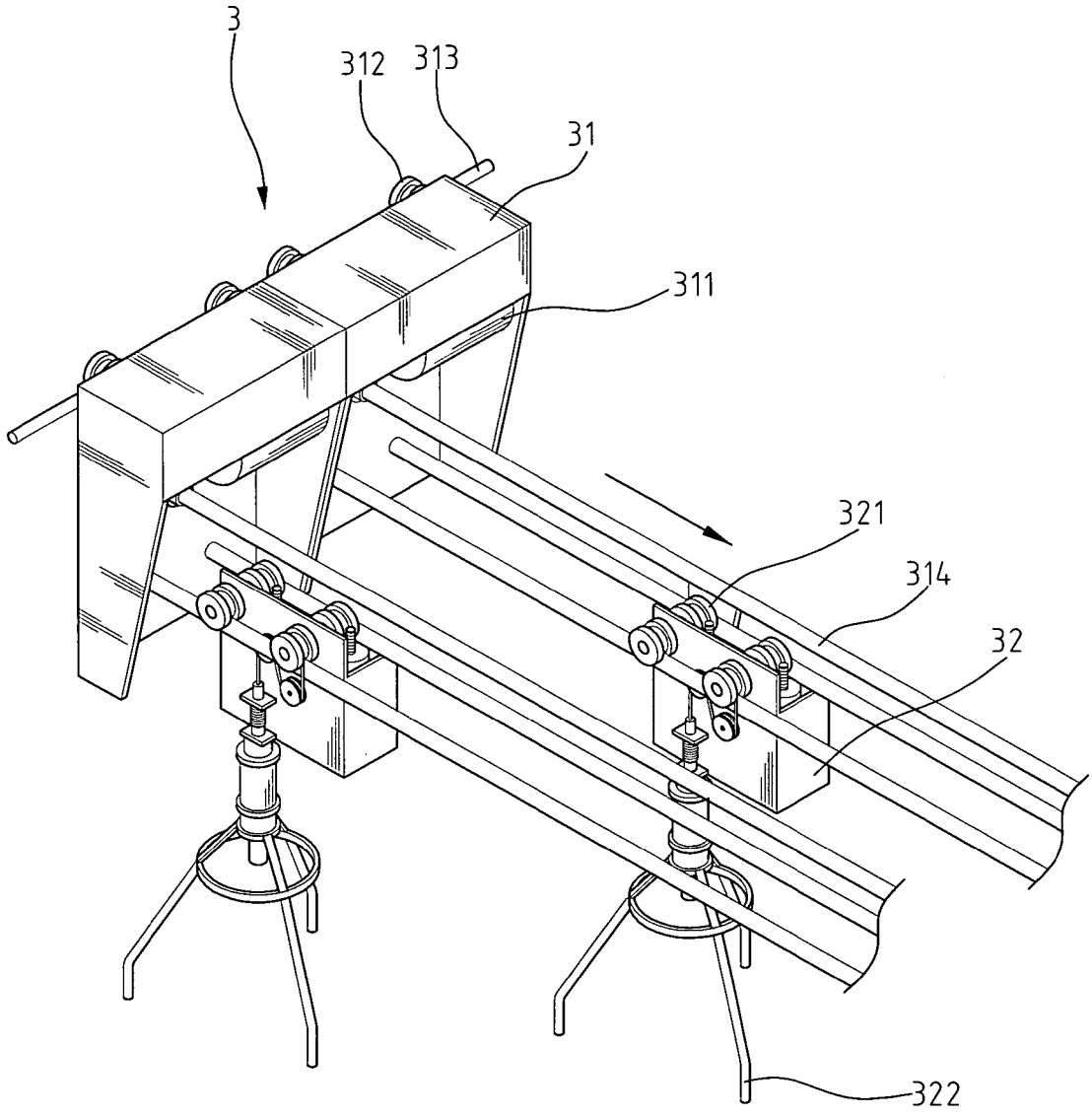
FIG. 5 shows the directional movement of transversal jenny in the second part of a mechanical arm.
Figure 6:
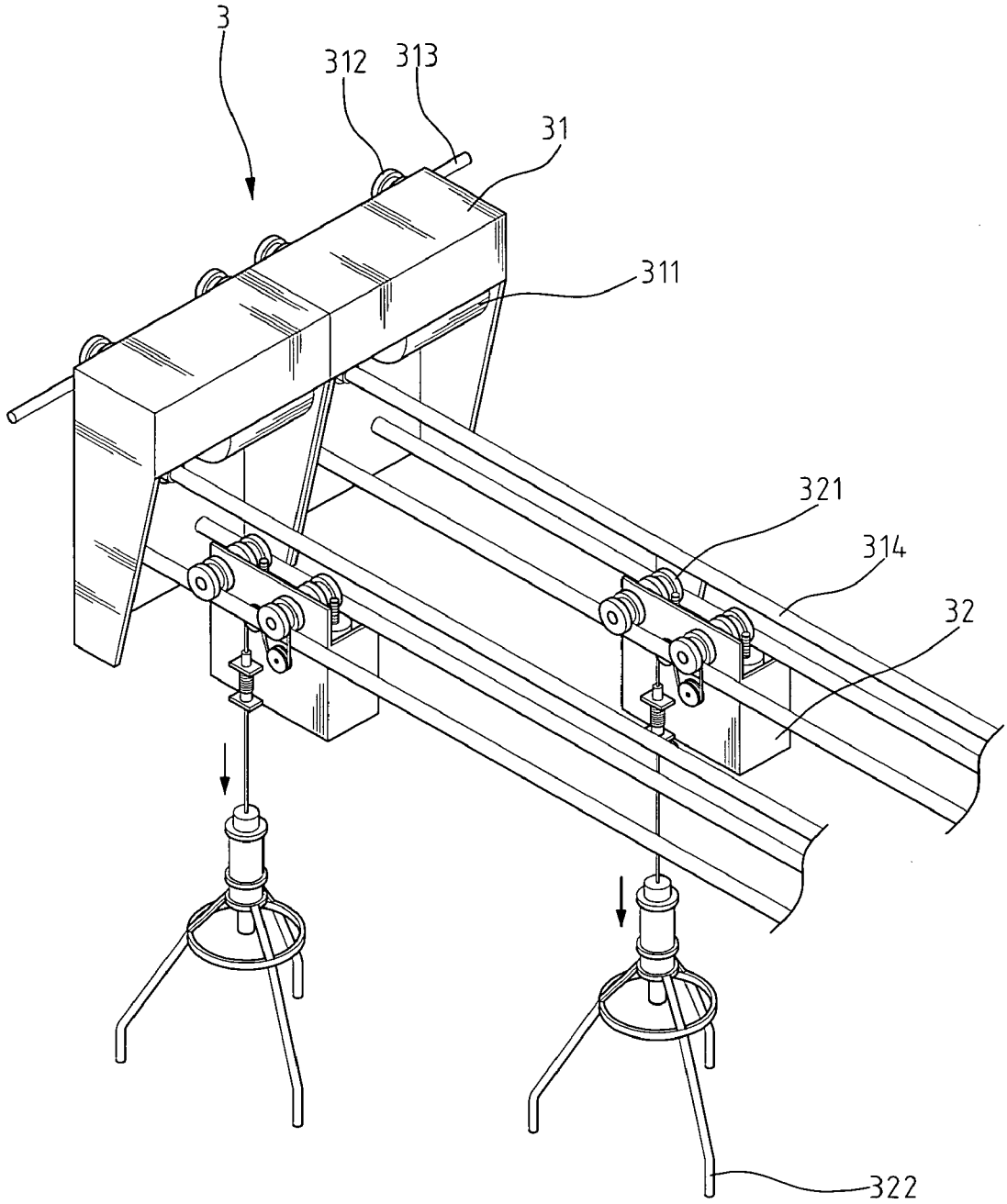
FIG. 6 shows a pair of mechanical arms with gripping tongs in action.

Referring to FIGS. 4–6, to operate the grabber machine, coins or tokens are first inserted into the coin slots 213, and then the mechanical arm 3 is maneuvered to align the gripping tong over a selected article through the action of the rocker 211. In the process, it is the circuit boards embedded in the longitudinal jennies 31 that first receives the input signal, which then enables the motor 311 inside the longitudinal jenny 31 to move the longitudinal jenny 31 to a new position along the longitudinal rail 313 using the attached rollers 312, and shortly after the circuit board inside the transversal jenny 32 also receives corresponding input signal to cause the motor to move the transversal jenny 32 to a new position along the transversal rail 314 using the attached rollers 321. Once the position is aligned over the selected article, the select button 212 is pressed to cause the gripping tong 322 to be lowered toward the article. If the selected article is successfully picked up, the article is dragged to the drop-out opening on one corner of the display cabinet, in coordination with associated jennies 31, 32, and the article is then released through the drop-out opening 11 to the bottom of the grabber machine, so that the player is able to retrieve the article through the pick-up bay 214.

Figure 2:
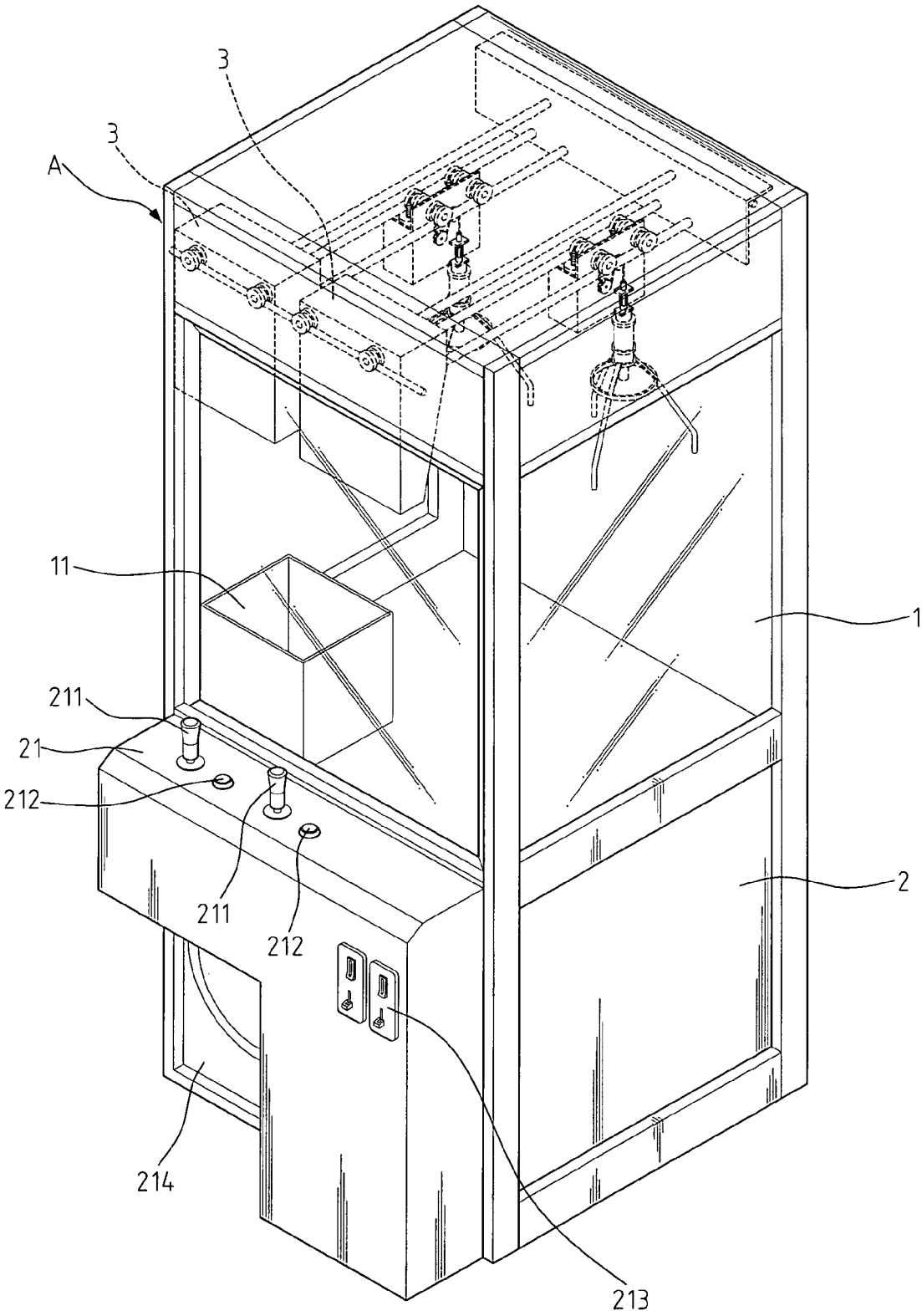
FIG. 2 is another example of the grabber machine with different arrangement for the mechanical arms.

A different set up of the mechanical arms 3 is shown in FIG. 2, whereby the longitudinal jennies are installed on separate longitudinal rails and connected with gripping tongs, while the transversal jennies are cascade-connected on a common transversal rail. The final set up is largely dependent on the actual arrangement of toys in the display cabinet to make it convenient for multiple players to manipulate the gripping tongs concurrently.

The above-mentioned grabber machine is normally set up for two players to operate the machine concurrently, but the grabber machine can be further expanded to support three concurrent players using the same architecture.

In accordance with the present invention, the above-mentioned grabber machine can be easily adapted for commercial purposes. With slight modification, the articles in the display cabinet of the grabber machine can be changed to merchandise for sale, as long as the weight and width of the articles can fulfill the requirements of the gripping tong for machine pick-up.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. An enhanced grabber machine comprising:

a display cabinet which is used to hold varieties of articles behind a plastic or glass panel;

a base and control cabinet, over which and in front of the display cabinet an operational panel is formed, with two or three sets of rockers and select buttons being installed thereon, and two or three coin slots and a pick-up bay formed on the front panel below the operational panel;

two or three sets of mechanical arms being installed below the ceiling of the display cabinet, each containing a longitudinal jenny and a transversal jenny, which is wire connected with a gripping tong;

wherein each longitudinal jenny is mounted using a pair of rollers on the back side of the longitudinal jenny to fit onto a common longitudinal rail, and the longitudinal jennies are cascade-connected on the common longitudinal rail and electrically connected to respective rockers and select buttons on the operational panel; each longitudinal jenny has a pair of transversal rails and a connecting rod extending from the broad side of the longitudinal jenny to a movable plate on the opposite side of the display cabinet, supported by a pair of rollers and a longitudinal rail;

wherein each transversal jenny is mounted using two rows of rollers attached on two sides to fit onto two separate transversal rails, where one end of the pair of transversal rails is connected to the broad side of a longitudinal jenny, and the other end is connected to the broad side of the movable plate on the opposite side of the display cabinet, and the transversal jennies are parallel-connected and electrically connected to respective rockers and select buttons on the operational panel;

wherein each longitudinal and transversal jenny is equipped with a motor and a transmission mechanism, and embedded with a circuit board used to drive the rollers, and the embedded circuit boards are electrically connected to the base and control cabinet for receiving input signals issued by the player through the rockers and select buttons.

2. The enhanced grabber machine as claimed in claim 1, wherein the display cabinet of the grabber machine has a drop-out opening near one corner, through which the selected article is to fall to the bottom of the grabber machine, so that the player is able to retrieve the article through the pick-up bay.

* * * * *